US008631530B2

(12) United States Patent
Zita

(10) Patent No.: US 8,631,530 B2
(45) Date of Patent: Jan. 21, 2014

(54) CLEANING DEVICE AND SYSTEM

(75) Inventor: Johann Zita, Gustavsberg (SE)

(73) Assignee: AB Electrolux (SE)

( * ) Notice: Subject to any disclaimer, the term of this patent is extended or adjusted under 35 U.S.C. 154(b) by 0 days.

(21) Appl. No.: 13/517,911

(22) PCT Filed: Dec. 17, 2010

(86) PCT No.: PCT/SE2010/000310

§ 371 (c)(1),
(2), (4) Date: Jun. 20, 2012

(87) PCT Pub. No.: WO2011/078761

PCT Pub. Date: Jun. 30, 2011

(65) Prior Publication Data

US 2012/0255133 A1 Oct. 11, 2012

Related U.S. Application Data

(60) Provisional application No. 61/289,922, filed on Dec. 23, 2009.

(30) Foreign Application Priority Data

Dec. 22, 2009 (SE) ..... 0901597

(51) Int. Cl.

| | |
|---|---|
| ***A47L 13/16*** | (2006.01) |
| ***A47L 13/38*** | (2006.01) |
| ***A47L 13/40*** | (2006.01) |

(52) U.S. Cl.
USPC ..... 15/1.52; 15/144.1; 15/144.4; 15/172; 15/209.1; 15/234

(58) Field of Classification Search
USPC ..... 15/1.52, 144.1, 144.4, 172, 209.1, 234
See application file for complete search history.

(56) References Cited

U.S. PATENT DOCUMENTS

| | | | | |
|---|---|---|---|---|
| 2,984,852 | A * | 5/1961 | George | 15/144.4 |
| 3,332,103 | A | 7/1967 | Case | |
| 5,495,633 | A * | 3/1996 | Speer | 15/104.94 |
| 8,136,196 | B2 * | 3/2012 | Dingert | 15/144.3 |
| 2006/0200929 | A1 | 9/2006 | Knopow et al. | |

FOREIGN PATENT DOCUMENTS

| | | | |
|---|---|---|---|
| CN | 2910100 | Y | 6/2007 |
| DE | 8910609 | U1 | 1/1990 |
| JP | 4-84926 | * | 3/1992 |
| JP | 2009125514 | A | 6/2009 |

* cited by examiner

*Primary Examiner* — Randall Chin
(74) *Attorney, Agent, or Firm* — RatnerPrestia

(57) ABSTRACT

This invention relates to a cleaning device (10) comprising a handle (20), a bendable elongated cleaning element (30) connected to the handle; and an elongated control element (40) having a first end (41) fixated at a top part (32) of the cleaning element. The control element is arranged along and inside of the cleaning element, and has a second end (42) arranged to be accessible at the handle. Controlled bending of the cleaning element is provided by applying a pulling force on the second end.

14 Claims, 4 Drawing Sheets

CLEANING DEVICE AND SYSTEM

This application is a U.S. National Phase application of PCT International Application No. PCT/SE2010/000310, filed Dec. 17, 2010 and claims priority to Swedish Patent Application No. 0901597-5 filed Dec. 22, 2009 and the benefit of U.S. Provisional Application No. 61/289,922 filed Dec. 23, 2009.

FIELD OF THE INVENTION

The present invention relates to a bendable cleaning device and a cleaning system comprising such a cleaning device.

BACKGROUND OF THE INVENTION

In general, cleaning devices like feather dusters comprising a handle upon which a cleaning element is attached are well-known. The use of these traditional cleaning devices still has its place in modern homes. The need for dusting off surfaces like fragile furniture, book shelves and other types of objects, and which requires a delicate dusting, works in the feather dusters favor. However, when cleaning tops of cabinets, suspended ceiling armatures, or other hard to reach surfaces, the traditional rigid cleaning devices are ineffective if the user does not reach far enough to use the wrist to adjust the angle of the cleaning device when cleaning.

CN2910100 Y, discloses a duster, which comprises a handle and a bendable duster unit for removing dirt, which duster unit is connected with the handle. The duster unit comprises a bendable strip-type thin metal sheet and a sponge unit covered at the outside of the bendable strip-type thin metal sheet. Via bending of the metal sheet within the duster unit, a user may select a desired angle of the duster unit. Further, the user may stretch the metal sheet again to regain its initial shape. Typically the user will have to use two hands to bend and stretch the duster unit. Thus, the bending and stretching of the metal sheet has to be done between dusting sessions.

SUMMARY OF THE INVENTION

It is an object of the present invention to provide a cleaning device which at least alleviates the drawbacks of prior art as described above.

This object is achieved by a dusting device according to the present invention as defined in the independent claims.

Thus, in accordance with a first aspect of the present invention, there is provided a cleaning device comprising a handle, a bendable elongated cleaning element connected to the handle, and an elongated control element having a first end fixated at a top part of the cleaning element. The control element is arranged along and inside of the cleaning element, and has a second end arranged to be accessible at the handle. Controlled bending of said cleaning element is provided by applying a pulling force on the second end.

This offers a convenient way of controlling the bending of the cleaning element by pulling the free end of the control element. The control element may be one of a string, a rod, a spring, and a rubber element. The cleaning device is advantageous for cleaning otherwise hard to reach places like, for example, heaters, and in and around ceiling mounted armatures, with an ad-hoc control of the bending of the cleaning element.

In accordance with an embodiment of the cleaning device, the cleaning element is resilient. Due to the resilience of the cleaning element, once the pulling force acting on the control element is removed or is decreased, the cleaning element returns fully to its initial shape, or as in the case of a decreased pulling force, the cleaning element is relaxed towards its initial shape. This further has the advantage of providing, within predetermined maximum and minimum limit values governed, for example, by the material and construction of the cleaning element and the control element, continuous bending of the cleaning element by applying an applicable pulling force.

In accordance with an embodiment of the cleaning device, the cleaning device further comprises an actuator arranged at the handle. The second end of the control element is fixated to the actuator. The actuator is arranged to provide the pulling force on the second end when being actuated. By means of the actuator an increased control and repeatability of the bending of the cleaning element may be provided. The actuator may be arranged in different ways, e.g. such that actuation of the control element is performed by moving the actuator towards the free end of the handle, pressing a button, or moving the actuator in a direction which is different from the normal pulling-out direction of the control element.

In accordance with an embodiment of the cleaning device, the actuator is arranged at a predetermined position of the handle for enabling bending of the cleaning element with a one hand operation. By placing the actuator at a suitable position with respect to the free end of the handle, a user may hold the cleaning device in one hand and reach the actuator with one or two fingers. Thereby a one hand grip for providing the bending of the cleaning element is provided. This is advantageous for instance, when a user is dusting an armature in the sealing and reaching out the arm to reach the area to be dusted. The bending of the cleaning element is conveniently activated on demand and by using the same hand that is holding the cleaning device, such that there is no need for interrupting the cleaning activity.

In accordance with an embodiment of the cleaning device, the cleaning device further comprises a locking element for locking the control element in an actuated state, which is advantageous as the bending is then maintained without the user having to keep the control element in the actuated position.

In accordance with an embodiment of the cleaning device, the handle further comprises a telescopic unit, inside which the control element is arranged. The extendable handle increases the useful range reached by the cleaning device.

In accordance with an embodiment of the cleaning device, the telescopic unit is fixated, in an extended state, by means of balanced friction between telescopically arranged parts of said telescopic unit, which is advantageous.

In accordance with an embodiment of the cleaning device, the telescopic unit is fixated, in an extended state, by means of at least one set of a spring loaded protrusion and a corresponding hole arranged on adjacent telescopically arranged parts, which is advantageous.

In accordance with an embodiment of the cleaning device, the cleaning element is hollow, and the telescopic unit is, in a retracted state, arranged to fit into the cleaning element. Thus, when not being in use, the telescopic unit may be completely inserted into the cleaning element, providing a compact solution which takes up a minimum of space.

In accordance with an embodiment of the cleaning device, the cleaning element comprises a fiber unit arranged on a fiber holder. The fiber unit comprises cleaning fibers. Thus, there is provided a cleaning element, wherein the fiber unit and the fiber holder are separate parts. Typically, for example, in a feather duster, cleaning fibers are twined together with a steel wire into an inseparable unit. In this inventive concept, the fiber unit may be removably arranged on the fiber holder such that the fiber unit can be exchanged or washed between uses. The separate arrangement further allows for different choices and combinations of functional materials when selecting the fiber holder and the fiber unit.

In accordance with an embodiment of the cleaning device, the fiber holder is a soft tubular member. In addition to being bendable, a soft inner part of the cleaning device is advantageous as compared to, for example, a typical feather duster solution, in which cleaning fibers are twined together with steel wire to form the feather duster. In the typical feather duster solution, a surface being cleaned may incidentally be scratched by the steel wire solution. By contrast, the soft inner part of the cleaning device according to the present inventive concept, provides a safe cleaning of delicate surfaces with low risk of scratching the surface.

In accordance with an embodiment of the cleaning device, the fiber holder is a rubber hose which is optionally pleated, which is advantageous. A rubber hose which is pleated along the extension of the hose facilitates bending of the cleaning element.

In accordance with an embodiment of the cleaning device, the material of the cleaning element is selected for providing charging of the cleaning element with static electricity when being rubbed against a second selected material. This is advantageous since electro static charging of the cleaning element increases the cleaning capacity of the cleaning device as the ability to attract and retain dust particles is improved.

In accordance with an embodiment of the cleaning device, at least a part of the cleaning element is removably arranged with respect to the handle, which provides the possibility to exchange or to wash up that part of the cleaning element when the cleaning device is not in use. The removably arranged part of the cleaning element may be attached to the cleaning device by means of a hook-and-loop fastener or any other suitable fastening means.

In accordance with a second aspect of the invention, there is provided a cleaning system comprising a cleaning device and a chamber for receiving the cleaning device. The chamber may be connectable to a vacuum source which is advantageous for cleaning dust from the cleaning device in connection to storing the cleaning device in the chamber. The system may be arranged in any suitable vacuum cleaner. Implementation of the dusting system in a vacuum cleaner is in addition to the advantages as explained above for the cleaning system itself, convenient as the user then has the option of using the cleaning device instead of using the vacuum cleaner hose and nozzle, and may in a smooth and user friendly way reach and clean surfaces on which normal vacuum cleaning is not suitable. The vacuum cleaner may be of any kind of suitable vacuum cleaner, e.g. a canister vacuum cleaner, a bagged or bag less vacuum cleaner, an upright vacuum cleaner, or a central vacuum cleaner.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Embodiments according to the present inventive concept will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout.

Figure 1A:
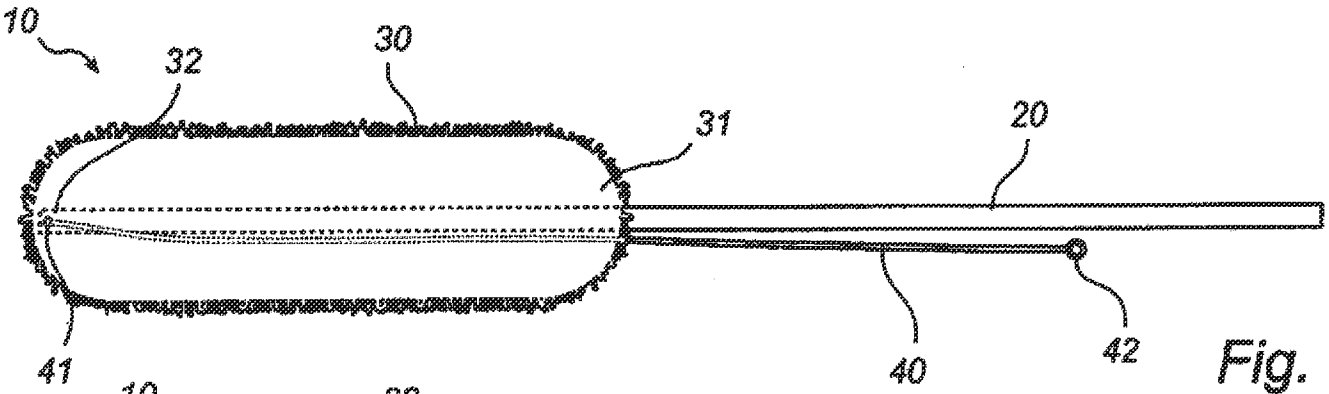
FIG. 1*a*) and *b*) are schematic side views illustrating embodiments of the cleaning device according to the present inventive concept.

In an embodiment of a cleaning device 10, as illustrated in the schematic cross sectional side view of FIG. 1*a*), the cleaning device 10 has a handle 20 onto which a bottom part 31 of a bendable cleaning element 30 is arranged. The cleaning element 30 is here a micro fiber cloth. The cleaning device further comprises a control element 40, which can be provided by means of one of a wire, a string, a rod, a spring, and a rubber element or any other suitable element.

Figure 1B:
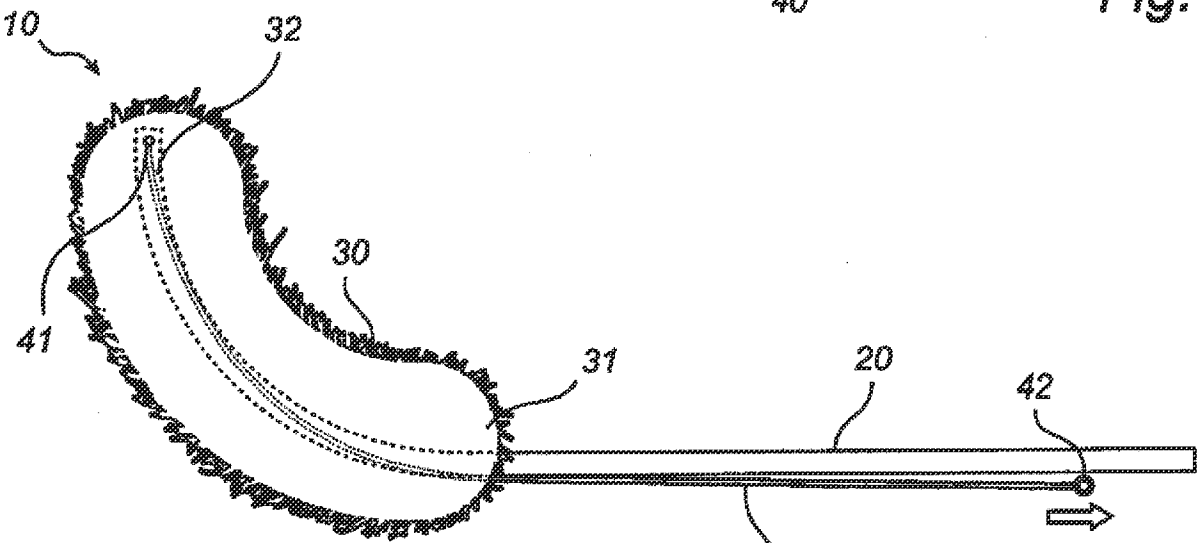

Further, a first end 41 of an elongated control element 40 is fixated at a top part 32 of the cleaning element 30, and runs within the cleaning element 30 to the bottom 31 of the cleaning element 30 and where it exits the cleaning element 30. The second end 42 of the wire is thus accessible to a user, which may hold the handle 20 and actuate the control element 40 by pulling the control element 40 in a direction out from the cleaning element 30. Thereby, the top part 32 of the cleaning element 30 is forced to bend, which is illustrated in FIG. 1 *b*). The cleaning element 30 is arranged to be resilient, so as to spring back to or towards its initial shape when the pulling force provided when actuating the control element is removed or decreased, respectively.

Thus, the basic idea is that the bendable cleaning element is forced to bend as the control element attached to the top part of the cleaning element is actuated. The degree of bending of the cleaning element is associated with the size of the pulling force applied to the control element, when actuating it.

Figure 2A:
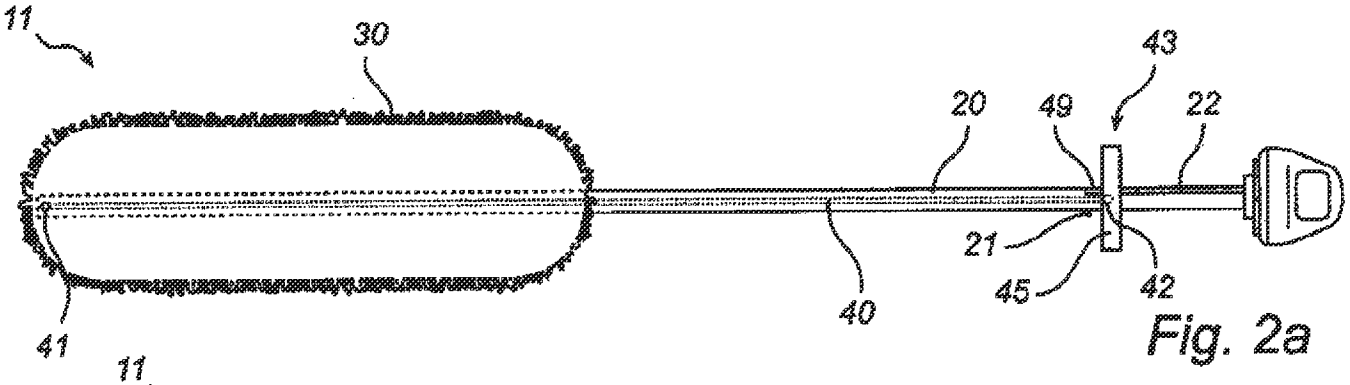
FIG. 2*a*) and *b*) are schematic side views illustrating an embodiment of the cleaning device according to the present inventive concept, and FIG. 2*c*) is a schematic perspective partly cut open close up of a detail of the same embodiment as in FIG. 2*a*) and *b*)
Figure 2B:
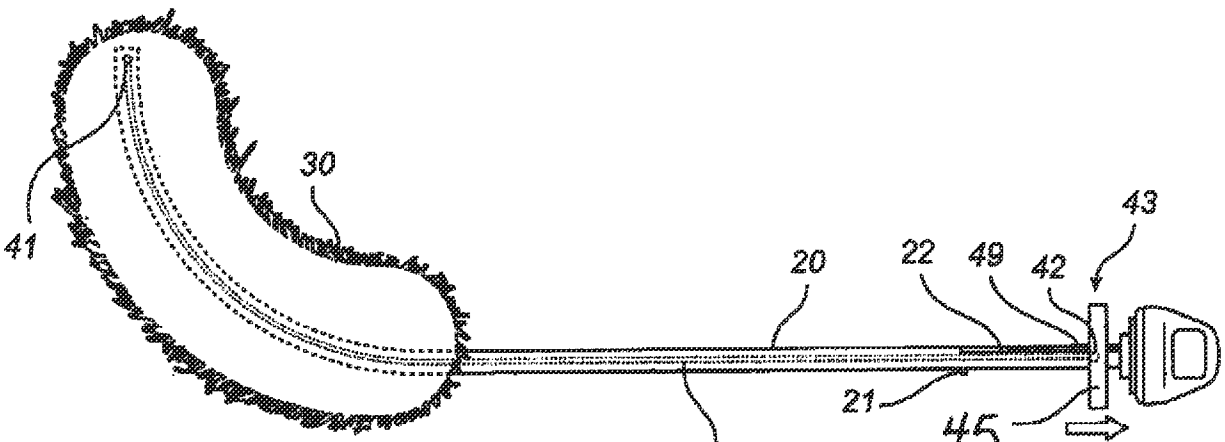
Figure 2C:
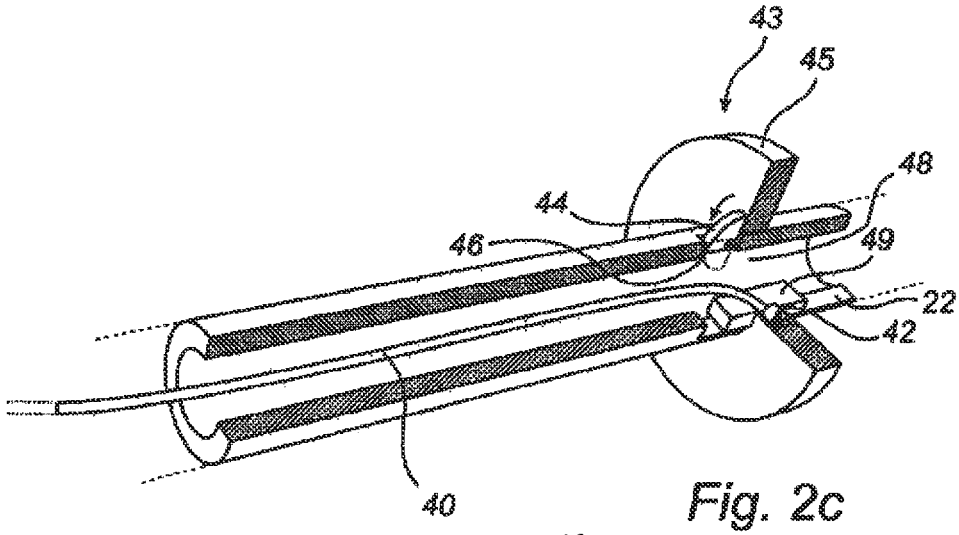

In an embodiment of a cleaning device 11, as illustrated in the schematic side view of FIG. 2 *a*), which has a similar basic arrangement as the cleaning device 10 described with reference to FIG. 1 *a*) and *b*), the handle 20 is arranged to be hollow, or at least to comprise a void channel. Thereby, the control element 40, which is fixated at the top part 32 of the cleaning element 30, and arranged to run within the cleaning element 30, is further allowed to enter into the handle 20, and run within the handle 20 to an actuator 43, onto which the second end 42 of the control element 40 is fixated. The actuator 43, which is illustrated in FIG. 2*c*, comprises a plate 45 having a center aperture 48 with substantially the same diameter and profile as the shaft 21 of the handle 20, through which aperture 48 the shaft 21 is inserted during assembly such that the plate 45 is perpendicularly and movably arranged while encompassing the shaft 21. Further, a guide piece 49 is arranged on the plate 45, which protrudes radially and inwardly towards the center of the shaft 21, and which is arranged to during movement of the plate 45 run within a slot 22 arranged in the wall of the shaft 21. The slot 22 is of predetermined length and governs the possible positions of the actuator 43. The slot 22 is preferably arranged such that in an initial position of the actuator 43, the cleaning element 30 is relaxed and no force is applied on the control element 40. When the actuator 43 is moved by the user from the initial position by pulling the plate 45 along the slot 22 towards the free end of the handle 20, the control element 40 is actuated, and the cleaning element 30 is bent.

In an embodiment of the cleaning tool as illustrated in the close up of FIG. 2*c*) the actuator 43 is further arranged with a locking element 44 for locking the actuator 43, and thus the control element 40 in an actuated state. The locking element 44 is here a spring-loaded protrusion 44 which locks into a corresponding aperture 46 arranged at a suitable predetermined position in the shaft of the handle 20. The position of the aperture 46 is preferably governed by the suitable maximum pulling-out of the control element 40 and the desired corresponding bending of the cleaning element 30. It should be mentioned that in addition to this example, any suitable locking element arrangement is applicable.

Figure 3:
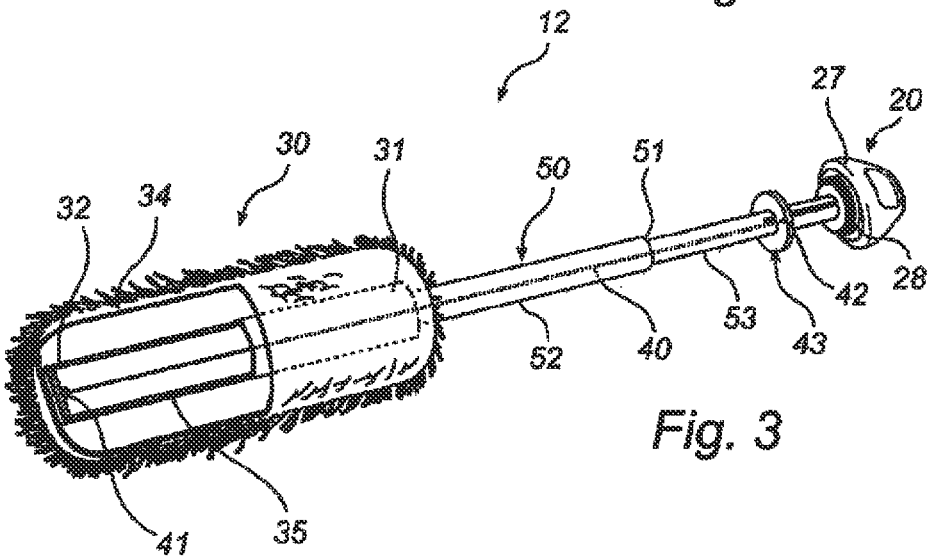
FIG. 3 is a schematic perspective partly cut open view illustrating an embodiment of the cleaning device according to the present inventive concept.

In an embodiment of the cleaning device 12, as illustrated in the cross-sectional side view of FIG. 3, the initial position of the actuator 43 is adapted to be within the reach of the fingers of a hand maneuvering the cleaning device 12. Thereby the bending of the cleaning element 30 is allowed with a one hand operation. The user holds a grip 27 arranged at the free end of the handle 20, while simultaneously reaching the actuator 43 with e.g. the index finger and the middle finger. When there is a need for bending the cleaning element 30, the user simply pulls the actuator towards the grip 27, and the cleaning element 30 is bent.

Further, a closing member 28 is arranged at the handle 20. The closing member 28 is formed to provide an air seal when the cleaning device is inserted into a chamber for storage. In the embodiment of a cleaning device as illustrated in the close up of a handle 20 in FIG. 3, closing member 28 is cone shaped. The conical surface of the closing member 28 provides a good air sealing between the cleaning device and the chamber; however, other shapes are applicable.

To continue, the cleaning device 12, as illustrated in FIG. 3, comprises a telescopic unit 50. The telescopic unit 50 is a hollow arrangement of telescopically arranged parts 52, 53, which together form an extendable shaft of the handle 20.

Figure 4A:
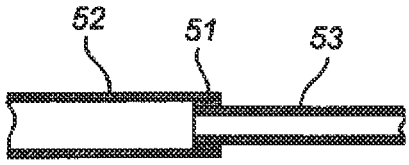
FIG. 4*a*) and *b*) are close up cross sectional schematic views illustrating details of an embodiment of a cleaning device according to the present inventive concept.

In an embodiment of the cleaning device, as illustrated in FIG. 4*a*), the telescopic unit 50 is, when being in an extended state, fixated by means of balanced friction, i.e. friction elements 51 arranged between the telescopically arranged parts 52, 53 of the telescopic unit 50 provide friction to keep the telescopically arranged parts fixated. A retraction of the telescopic unit 50, is obtained by applying a retraction force larger than the balanced friction force onto the telescopic parts.

Figure 4B:
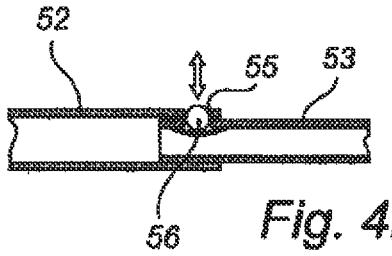

In an embodiment of the cleaning device, as illustrated in FIG. 4*b*), the telescopic unit 50 is fixated in an extended state by means of at least one set of a spring loaded protrusion 56 and a corresponding hole 55 arranged on adjacent telescopically arranged parts 52, 53. The spring loaded radially extending protrusion 56 automatically locks the telescopic parts 52, 53 when the hole 55 comes into position in front of the protrusion 56. To retract the telescopic part, either a retraction force larger than a threshold force caused by the spring force and the hole has to be applied or, alternatively, the user may release the protrusion 56 by pressing the protrusion 56 inwards the telescopic part and simultaneously retracting the telescopic parts.

The control element 40, which is fixated at the top part 32 of the cleaning element 30, and arranged to run within the cleaning element 30, is further allowed to enter into the handle 20, where it runs within the telescopic unit 50 to the actuator 43, onto which the second end 42 of the control element 40 is fixated. The control element 40 is here a flexible wire.

The elongated cleaning element 30, here comprises a fibre holder 35 onto which a fiber unit 34, is arranged. The fibre unit 34 comprises fibres suitable for collecting dust. In the embodiment as depicted in FIG. 3, the fibre holder is a flexible soft tubular member and the telescopic unit 50 is arranged to in a retracted state fit into the fibre holder 35. The fibre holder 35 is thus arranged to act as a telescopic part with the adjacent telescopic part 52, in a similar way as described above for the telescopic parts 52, 53 of the telescopic unit 50. That is, the fibre holder 25 may receive and contain telescopic part 52. The telescopic unit 50 is typically contained in the fibre holder when the cleaning device is not in use.

As mentioned the fiber holder 35 is here soft tubular member, e.g. a rubber hose, which is optionally pleated to emphasize bending of the hose as the actuator 43 is activated to obtain bending of the cleaning element 30.

In alternative embodiments of the cleaning device, the fiber unit is permanently fixated to the fiber holder, e.g. when long fibers are twined together with steel wire to form the cleaning element. The cleaning element may in other embodiments be realized as one piece, e.g. when the fiber holder itself contains the cleaning fibers, like for a tubular or cylindrical microfiber unit.

Further, the fiber unit is in embodiments of the cleaning device arranged to be removable, or exchangeable. The fiber unit may then be removed to be washed, or be exchanged by a fiber unit with the same or different material. The attachment of the fiber unit to the fiber holder is in embodiments of the cleaning device arranged by means of a hook-and-loop fastener (not shown) or other suitable fastening means.

As mentioned before, the cleaning device may be arranged in a chamber for storage, which cleaning device and chamber then forms a cleaning system according to the present inventive concept. The material of the cleaning element 30, is in an embodiment of a cleaning system selected so that when the cleaning fiber are rubbed against one another or alternatively against the side walls of the chamber, charging with static electricity is provided. The materials of the cleaning fiber and the walls of the chamber are optimized with respect to each other to provide a high charging rate. Materials suitable for providing high charging rates are e.g. microfiber materials such as a polyethylene mix, supplied from Starfiber or Aquastar.

Figure 5:
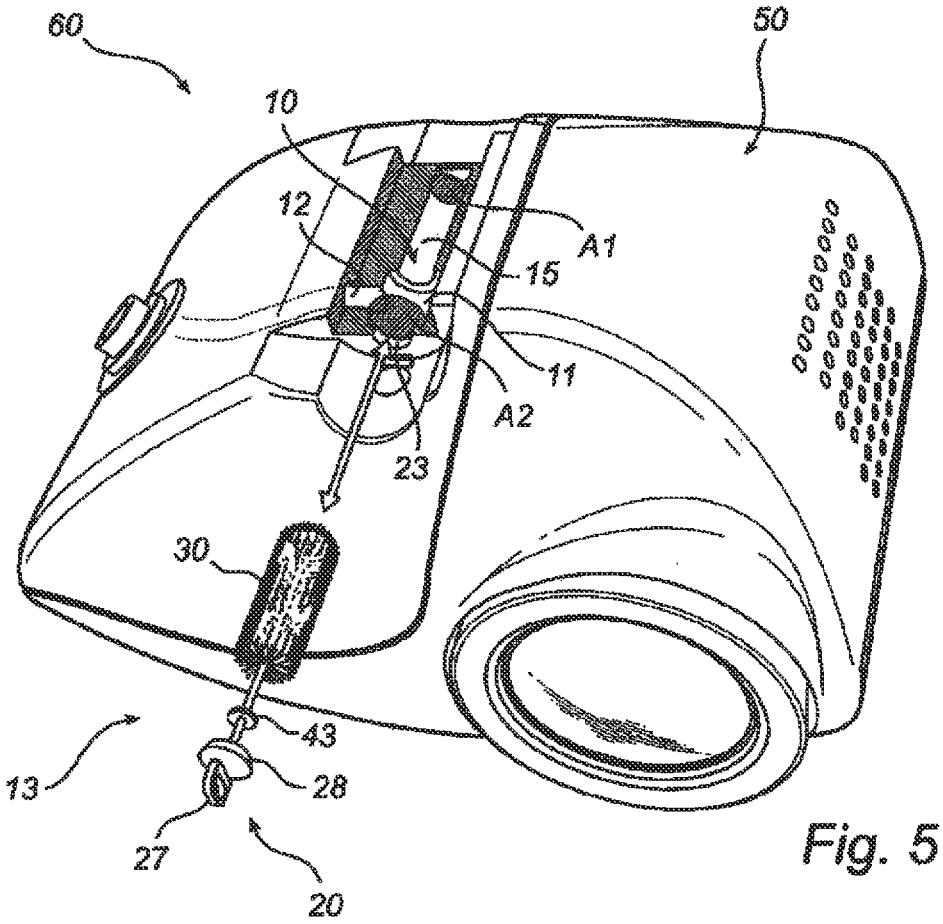
FIG. 5 is a schematic perspective partly cut open view of an embodiment of a cleaning system according to the present inventive concept, when being implemented in a vacuum cleaner.

The chamber for storing the cleaning device may be arranged in a vacuum cleaner 50, as is depicted in FIG. 5 which is a schematic perspective illustration of an embodiment of the dusting system according to the present inventive concept. The cleaning system 60 comprising a cleaning device 13 and a corresponding chamber 10, is shown with the cleaning device 13 fully extracted and being outside the chamber 10. The cleaning device 13 in this embodiment a feather duster having a handle 20 onto which an elongated cleaning element 30 is arranged. An actuator 43 is arranged at the handle 20 in a similar way as previously described for the embodiment of the cleaning device with reference to FIG. 3, with the difference that the handle 20 in this embodiment does not comprise a telescopic unit. A grip 27 is provided at the free end of the handle 20, and further a closing member 28 arranged at the grip provides air sealing of the chamber 10 as the cleaning devices is inserted in the chamber 10 through the chamber opening 23.

The chamber 10 is arranged to fit the cleaning device 13, and comprises a cleaning compartment 11 arranged at its entrance, e.g. opening 23, in which the cleaning device is inserted when entering the chamber 10. The cleaning compartment 11 is further arranged having an outlet 12 for facilitating fluid communication between the chamber and a vacuum source (not shown) of the vacuum cleaner 50, in which the cleaning system 60 is arranged. The vacuum source may alternatively be provided by connecting the cleaning system to a central vacuum cleaner, or be provided by means of a fan unit and dust collector as an integrated part of the dusting system, such that a free-standing and optionally mobile dusting system is provided.

Further, the chamber 10 comprises a storage compartment 15 arranged in connection to the cleaning compartment 11 and opposite to the opening 23. The chamber is further arranged such that the cross-sectional area A2 of the cleaning compartment 1, in a plane perpendicular to the extension of the chamber 0, is sufficiently large to allow the fibers for the cleaning portion to move freely and due to this facilitate removing of dust and particles from the part of the cleaning portion which is present in the cleaning compartment 11 and being subjected to the suction force provided by the vacuum source. To continue, the cross-sectional area A1 of the storage compartment is smaller than the cross-sectional area A2 of the cleaning compartment. This results in that the cleaning element 30 is compressed as it is inserted in the storage compartment 15.

The cross sectional profile of the cleaning compartment is preferably kept as smooth as possible, and is arranged having the same diameter along the whole length of the cleaning compartment to avoid turbulent air streaming and creation of unwanted sounds as air is flowing through the cleaning compartment 11.

Above, embodiments of the dusting system according to the present inventive concept as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A cleaning device (10) comprising:

a handle (20);

a bendable elongated cleaning element (30) connected to said handle;

an elongated control element (40) having a first end (41) fixated at a top part (32) of said cleaning element, said control element being arranged along and inside of said cleaning element, and having a second end (42) arranged to be accessible at said handle; and an actuator (43) arranged at said handle, said second end of said control element being fixated to said actuator, said actuator being arranged to provide a pulling force on said second end when being actuated, and said actuator being arranged at a predetermined position of said handle for enabling bending of said cleaning element with a one hand operation, said actuator having an aperture (48), wherein the handle is movably arranged inside the aperture.

2. A cleaning device according to claim 1, wherein said cleaning element (30) is resilient.

3. A cleaning device according to claim 1, further comprising a locking element (44) for locking said control element (40) in an actuated state.

4. A cleaning device according to claim 1, wherein said handle (20) further comprises a telescopic unit (50), said control element (40) being arranged inside said telescopic unit.

5. A cleaning device according to claim 4, wherein said telescopic unit (50) is fixated, in an extended state, by means of balanced friction between telescopically arranged parts (52, 53) of said telescopic unit.

6. A cleaning device according to claim 4, wherein said telescopic unit (50) is fixated, in an extended state, by means of at least one set of a spring loaded protrusion (56) and a corresponding hole (55) arranged on adjacent telescopically arranged parts (52, 53).

7. A cleaning device according to claim 4, wherein said cleaning element (30) is hollow, and wherein said telescopic unit (50) is, in a retracted state, arranged to fit into said cleaning element.

8. A cleaning device according to claim 1, wherein said cleaning element (30) comprises a fiber unit (34) arranged on a fiber holder (35), said fiber unit comprising cleaning fibers.

9. A cleaning device according to claim 8, wherein said fiber holder (35) is a soft tubular material.

10. A cleaning device according to claim 9, wherein said fiber holder (35) is a rubber hose.

11. A cleaning device according to claim 10, wherein said fiber holder (35) is pleated.

12. A cleaning device according to claim 1, wherein the cleaning element (30) comprises a material that is selected for providing charging of said cleaning element with static electricity when being rubbed against a second selected material, wherein the second selected material is not part of the cleaning element.

13. A cleaning device according to claim 1, wherein at least a part of said cleaning element (30) is removably arranged with respect to the handle (2).

14. A cleaning system comprising:

a cleaning device comprising:

a handle (20), a bendable elongated cleaning element (30) connected to said handle, an elongated control element (40) having a first end (41) fixated at a top part (32) of said cleaning element, said control element being arranged along and inside of said cleaning element, and having a second end (42) arranged to be accessible at said handle, and an actuator (43) arranged at said handle, said second end of said control element being fixated to said actuator, said actuator being arranged to provide a pulling force on said second end when being actuated, and said actuator being arranged at a predetermined position of said handle for enabling bending of said cleaning element with a one hand operation, said actuator having an aperture (48), wherein the handle is movably arranged inside the aperture; and a chamber (10) for receiving said cleaning device.

* * * * *